United States Patent [19]

Zanzie

[11] 4,102,590

[45] Jul. 25, 1978

[54] PULL TYPE ASPHALT PAVER

[75] Inventor: Edward A. Zanzie, St. Louis, Mo.

[73] Assignee: Paving Products, Inc., St. Louis, Mo.

[21] Appl. No.: 851,150

[22] Filed: Nov. 14, 1977

[51] Int. Cl.[2] ..... E01C 19/18

[52] U.S. Cl. ..... 404/110; 404/104

[58] Field of Search ..... 404/110, 108, 101, 104, 404/105

[56] References Cited

U.S. PATENT DOCUMENTS

| | | | |
|---|---|---|---|
| 1,767,243 | 6/1930 | Kime | 404/110 |
| 2,586,396 | 2/1952 | Trampler | 404/110 |
| 2,622,494 | 12/1952 | Parson | 404/110 |
| 2,953,977 | 9/1960 | Warren | 404/110 |
| 3,213,769 | 10/1965 | Smith | 404/110 |
| 3,288,041 | 11/1966 | Layton | 404/108 |
| 3,300,234 | 1/1967 | Layton | 404/110 X |
| 3,335,646 | 8/1967 | Crayton | 404/110 |
| 3,874,807 | 4/1975 | Puckett | 404/110 |
| 3,907,451 | 9/1975 | Fisher | 404/101 |
| 3,909,146 | 9/1975 | Hoffman | 404/110 |

*Primary Examiner*—Nile C. Byers
*Attorney, Agent, or Firm*—Michael Kovac

[57] ABSTRACT

A pull type asphalt paver for spreading asphalt onto a road surface is disclosed as having means to avoid dump truck damage to the paver during operation and transporting thereof, means to readily enlarge the width of an asphalt layer on a road surface, and means to facilitate the metering and control of asphalt discharged by the paver on a road surface.

5 Claims, 5 Drawing Figures

PULL TYPE ASPHALT PAVER

SUMMARY OF THE INVENTION

There are two types of asphalt paving machines: self-propelled asphalt paving machines and dump truck pulled asphalt pavers. The present invention is directed to asphalt pavers of the last mentioned type.

Pull type asphalt pavers include a wheeled frame with a hopper which receives asphalt supplies from a dump truck associated therewith. In machines of this type, the hopper has a limited capacity and must be refilled from time to time by the dump truck. As the refilling takes place, the bed of the dump truck is raised and the present construction of pavers causes damage to the hopper during the filling and refilling process. Also, during transportation, paver hoppers are sometimes telescoped relative to the rear of the dump truck bed, and hopper damage can be caused when the dump truck turns or goes around curves.

The width and thickness of the asphalt layer that is laid on a road surface is also limited with present pull type pavers. It is apparent that the operation and economy of pull type paving machines can be facilitated where greater control of the width and thickness of the asphalt being laid can be exercised.

Accordingly, it is an object of the present invention to provide a new and improved pull type paver which overcomes the aforementioned deficiencies.

More specifically, it is an object of the present invention to provide a pull type paver which is not subject to damage during operation and transport thereof.

Another object of the present invention is to provide a new and improved pull type paver wherein the width and thickness of asphalt to be laid can be controlled with greater accuracy and within a greater range.

These and other objects and advantages of the present invention are achieved by a pull type paver construction including a wheeled frame which supports a hopper for receiving asphalt from a dump truck associated therewith, said hopper having a bottom section, a back section and opposite side sections connecting the bottom and back sections to each other, said hopper also being provided with a chute in the vicinity of the juncture of the bottom and back sections through which the asphalt is discharged onto a road surface, said hopper further being provided with laterally movable wing sections on opposite sides of said hopper along bottom and side sections thereof to accomodate dumping of the asphalt into the hopper when the dump truck bed is raised without causing contact between the dump truck and the paver. The laterally movable wing sections may also include bottom, side and back extensions wherein the back extension is pivotally mounted to a hopper side section to allow asphalt to be discharged through the bottom and side extensions of each laterally movable wing section. The hopper may also include a pivotally mounted hopper gate supported from the hopper back section to control and meter the flow of asphalt to the road surface.

DESCRIPTION OF THE PREFERRED EMBODIMENTS

Figure 1:
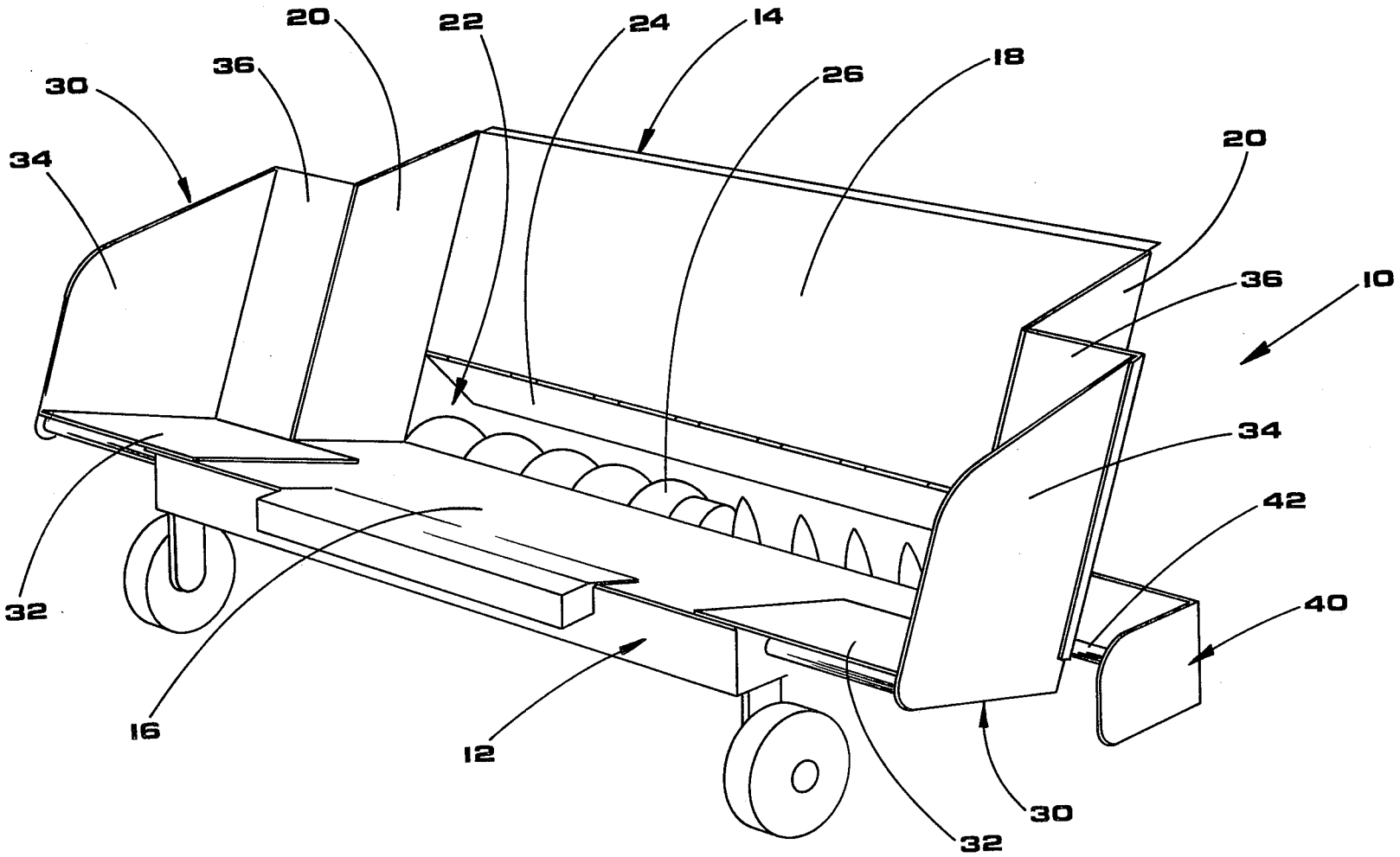
FIG. 1 is a perspective view of a pull type paver which is constructed in accordance with the present invention.

The pull type paver 10 shown in FIG. 1 of the drawings includes a wheeled frame 12 which supports a hopper 14 that receives and discharges asphalt materials. The hopper 14 includes a bottom section 16, a back section 18 and opposite side sections 20, 20 which connect the bottom and back sections 16, 18 respectively of the hopper 14 to each other.

The hopper 14 also is provided with a chute 22 in the vicinity of the juncture of the bottom and back sections 16, 18 respectively through which asphalt is discharged onto a road surface. A pivotally mounted hopper gate 24 is shown as being supported by the back section 18 for metering and controlling the flow of asphalt, in conjunction with other paver elements, as will presently appear.

Figure 5:
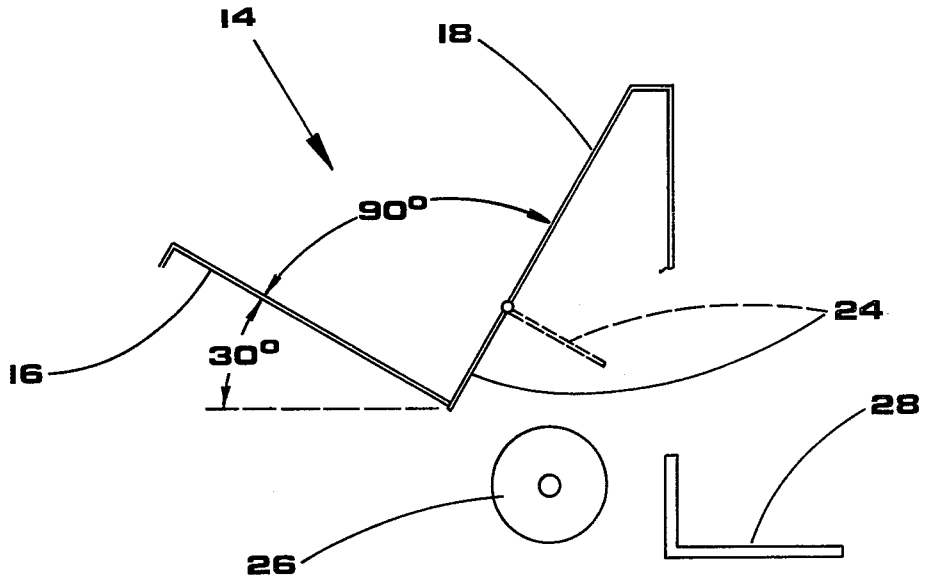
FIG. 5 is a fragmentary side elevational view of that portion of the pull type paver shown in FIG. 4.

A rotatably mounted auger spreader 26, supported by the hopper 24 and screed section 28, can be seen through the chute 22 in FIG. 1 of the drawings. The auger spreader 26 is driven by motor means (not shown) associated with the paver 10. The auger spreader 26 feeds asphalt from the chute 22 to a road surface to be paved. In order to level the asphalt surface, the screed section 28, as shown partially in FIGS. 3 and 5, is supported by the wheeled frame 12 downstream of the auger spreader 26 for leveling the asphalt on the road surface after it has been spread thereon.

During filling and refilling of the hopper 14, the dump truck bed (not shown) is raised and with present paver constructions, damage can be caused to the paver. Also, when presently constructed pull type pavers are transported by an associated dump truck (not shown), hopper damage can be caused when the dump truck is turned or goes around a curve.

Figure 2:
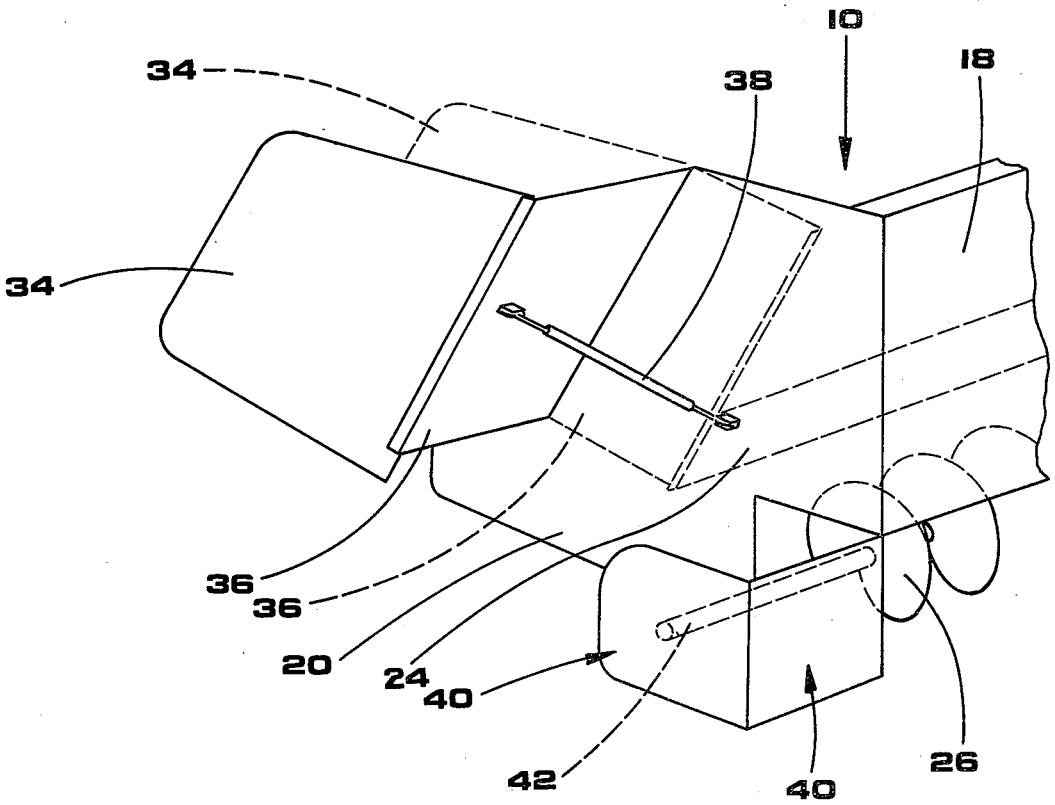
FIG. 2 is a fragmentary rear perspective view of the laterally extending wing sections of the herein disclosed pull type paver.
Figure 3:
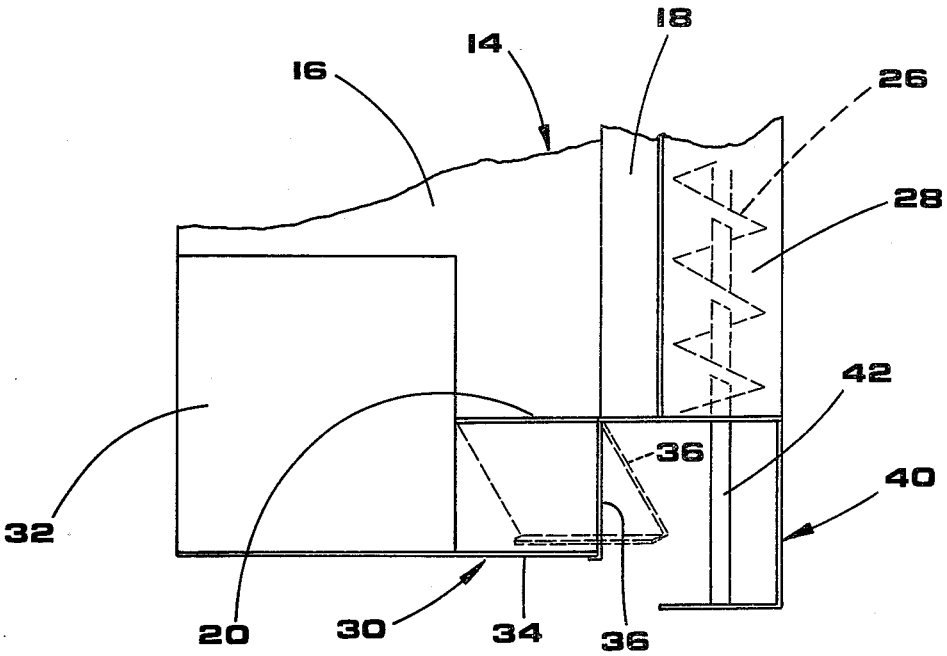
FIG. 3 is a fragmentary top plan view of that portion of the pull type paver shown in FIG. 2.

In order to prevent damage to the hopper 14 during operation and transport of the paver 10 of the present invention, it will be seen in FIGS. 1–3 that there is provided laterally extendable wing sections 30, 30 on opposite sides of the hopper 14. Specifically, it will be seen that each laterally extendable wing section 30 includes a bottom extension 32, a side extension 34 and a back extension 36. Hydraulically operated shafts 38, supported in the hopper 14 are connected to the side extensions 34 and thereby to the bottom extensions 32 which are fixed relative to the side extensions 34. The back extensions 36 of each laterally extendable wing section 30 are pivotally mounted relative to the side sections 20 of the hopper and are configured and dimensioned to engage over the rear edge of the side extensions 34 when fully extended, and held there by removable struts 38 as seen in FIG. 2.

Thus, it can be seen that the laterally extendable wing sections 30, 30 on each side of the hopper 14 can be laterally extended from a position in alignment with the side sections 20 to a laterally outwardly extended position therefrom as shown in FIGS. 1–3 to prevent damage to the paver during operation and transportation thereof.

As a further important feature of the present invention, it will be seen that the back extensions 36 of each laterally extendable wing section 30 are pivotally mounted on the side sections 20 of the hopper 14 to enable the back extensions 36 to be disposed substantially parallel to the side sections 20 of the hopper 14 and thereby allow asphalt to be discharged through the bottom and side extensions 32, 34 respectively of each laterally extendable wing section 30, in addition to asphalt that is discharged through the chute 22. As a result, the pull type paver 10 of the present invention can discharge an asphalt layer or bed substantially greater than the typical 8 ft. layer or bed of presently constructed pavers. Since it is contemplated that each laterally extendable wing section will extend up to approximately 8 in. on each side of the hopper 14 (for a hopper total over 9 ft. in width), the pull type paver of the present invention can, through controlled metering, discharge an asphalt layer or bed of greater width than prior designs.

In order to facilitate the spreading and leveling of asphalt discharged, by controlled metering, through the bottom and side extensions 32, 34 respectively of each laterally extending wing section 30, the screed section 28 includes a screed extension 40 that is laterally moved outwardly relative to the side section 20 of the hopper 14 by the hydraulically operated shaft 42 that extends from the auger spreader 26. The screed extensions 40, on each side of hopper 14, are capable of being moved laterally outwardly by a distance corresponding to the extension of the laterally movable wing sections 30 to produce the desired leveling over the full width of the asphalt layer or bed that is desired.

Figure 4:
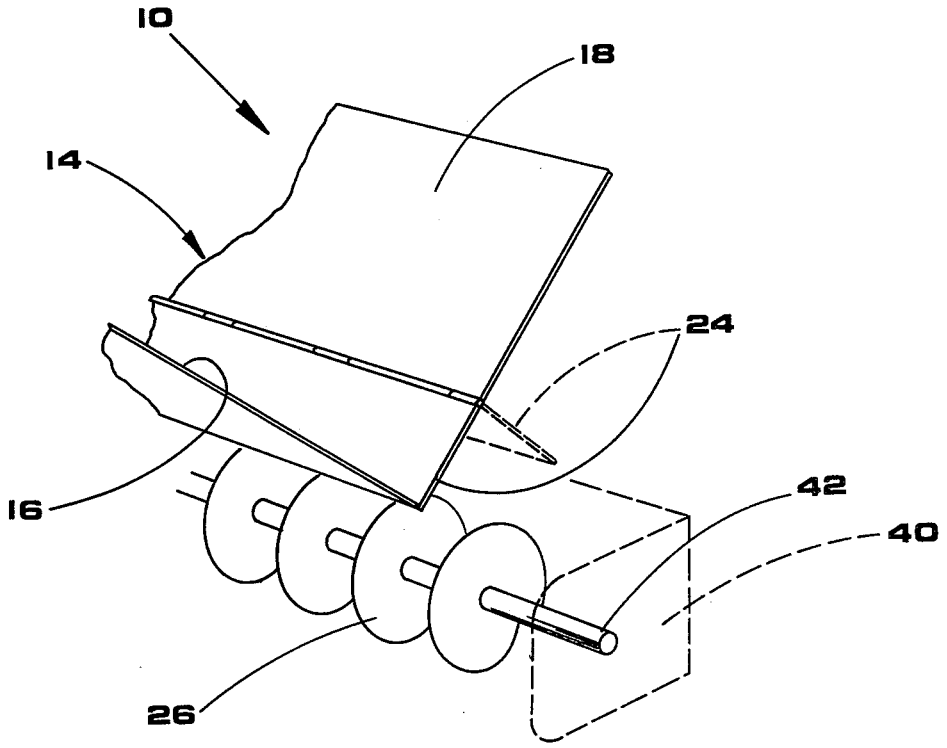
FIG. 4 is a fragmentary side perspective view of the metering and control elements associated with the hopper chute of the herein disclosed pull type paver.

As a further important feature of the present invention, reference is now made to the pivotally mounted hopper gate 24, in conjunction with other elements of the paver. As best seen in FIGS. 4 and 5, the bottom section 16 of hopper 14 is angularly inclined toward the back section at an angle of approximately 30° from horizontal, while the back section 18 of the hopper 14 is at an angle of approximately 90° relative to the bottom section 16. The pivotally mounted hopper gate 24 is thus capable of being moved into alignment with the back section 18 of the hopper 14, when fully closed, as well as being moved to a position approximately at right angles to the back section 18, as shown in the dotted line configurations in FIGS. 4–5 of the drawings, when fully opened. Due to the pivoted opening and closing of the hopper gate 24 relative to the bottom and back sections 16, 18 respectively of the hopper 14, a lot of power is not required to control the metering and cutoff of the asphalt. Also, the metering of the asphalt by the hopper gate 24 cutoff is independent of the screed extensions 40 to allow paving to the edge of the asphalt bed, without leaving any excess material to be removed by hand. Thus, with very little resistance and with accurate metering, the asphalt layer or bed to be deposited on a road surface can be controlled, not only in terms of the thickness desired, but the asphalt layer or bed can be laid right up to the edge of the areas to be paved.

This kind of metering and control has not been possible with prior art pull type pavers, particularly where visibility of the layer being discharged has been obstructed. In the present invention; however, the operator of the pull type paver can see, from the rear of the paver, as seen in FIGS. 2 and 5, the hopper gate 24, the auger 26, and thus the asphalt being discharged from the hopper 14. Typically, the operator stands on the screed section 28, which is partially shown in the drawings, where he can control the metering of asphalt through the chute 22, and along the laterally extendable open wing sections 30.

From the foregoing, it will be appreciated that the pull type paver of the present invention not only prevents hopper damage by dump trucks associated therewith, but provides greater control within a broader range of width and thickness of asphalt layers or beds to be laid, thus assuring greater flexibility and economy with less maintenance, than prior art pull type pavers.

I claim:

1. A pull type asphalt paver for spreading asphalt onto a road surface, said paver including a wheeled frame which supports a hopper for receiving asphalt from a dump truck associated therewith, said hopper having a bottom section, a back section and opposite side sections connecting the bottom and back sections to each other, said hopper also being provided with a chute in the vicinity of the juncture of the bottom and back sections through which the asphalt is discharged onto a road surface, said hopper further being provided with laterally movable wing sections on opposite sides of said hopper along bottom and side sections thereof to accomodate dumping of asphalt into the hopper when the dump truck bed is raised without causing contact between the dump truck and the paver, each laterally movable wing section on opposite sides of said hopper being provided with a bottom extension, side extension and back extension, the bottom and side extensions of each laterally movable wing section being laterally movable in and out relative to the bottom and side sections of the hopper, and the back extension of each laterally movable wing section being pivotally mounted relative to the side sections of the hopper in order to enable the back extension of each laterally movable wing section to be disposed substantially parallel to the side sections of the hopper and allow asphalt to be discharged through the bottom and side extensions of each laterally movable wing section.

2. The pull type paver as defined in claim 1 and including an auger indirectly supported by the wheeled frame which is positioned adjacent the chute for spreading asphalt on the road surface that is discharged through said chute, and a screed section supported by the wheeled frame that is positioned downstream of the auger for leveling the asphalt spread onto the road surface, said screed section having a screed extension corresponding to the extension of the laterally movable wing sections.

3. The pull type paver as defined in claim 2 and including a pivotally mounted hopper gate supported from the back section to control and meter the flow of asphalt from the chute to the road surface.

4. The pull type paver as defined in claim 3 wherein the bottom section of the hopper is inclined toward the back section at an angle of approximately 30° from horizontal, and the back section of the hopper is at an angle of approximately 90° relative to said bottom section, said pivotally mounted hopper gate when fully closing said chute being in alignment with said back section.

5. The pull type paver as defined in claim 4 and including an auger supported by the wheeled frame which is positioned adjacent the chute for spreading asphalt on the road surface that is discharged through said chute, and a screed section supported by the wheeled frame that is positioned downstream of the auger for leveling the asphalt spread onto the road surface, said chute, pivotally mounted gate and auger being visible by an operator standing on the screed section to facilitate control and metering of asphalt discharged through said chute.

* * * * *